US007895693B2

(12) United States Patent
Woodmansee, III et al.

(10) Patent No.: US 7,895,693 B2
(45) Date of Patent: Mar. 1, 2011

(54) LIGHTWEIGHT MODULAR FOOTBRIDGE AND LADDER

(75) Inventors: John W. Woodmansee, III, Plano, TX (US); Robert A. Woodmansee, Frisco, TX (US); Gary Hemby, Burleson, TX (US)

(73) Assignee: Tactical & Rescue Gear, Ltd., Plano, TX (US)

( * ) Notice: Subject to any disclaimer, the term of this patent is extended or adjusted under 35 U.S.C. 154(b) by 217 days.

(21) Appl. No.: 12/058,452

(22) Filed: Mar. 28, 2008

(65) Prior Publication Data

US 2009/0007348 A1 Jan. 8, 2009

Related U.S. Application Data

(60) Provisional application No. 60/920,436, filed on Mar. 28, 2007.

(51) Int. Cl.
*E01D 15/12* (2006.01)

(52) U.S. Cl. ..... 14/69.5; 14/71.1; 182/21; 182/115

(58) Field of Classification Search ..... 14/69.5, 14/71.1; 182/21, 115–126
See application file for complete search history.

(56) References Cited

U.S. PATENT DOCUMENTS

| | | | | |
|---|---|---|---|---|
| 511,605 | A | 12/1893 | Fredrick | |
| 595,629 | A | 12/1897 | Horton | |
| 976,074 | A * | 11/1910 | Hartman | 182/24 |
| 1,330,771 | A | 2/1920 | Tregillus | |
| 1,360,931 | A | 11/1920 | Graves | |
| 1,480,882 | A | 1/1924 | Davidson | |
| 1,654,151 | A | 12/1927 | Tregillus | |
| 2,614,512 | A | 10/1952 | Gross | |
| 2,704,522 | A | 3/1955 | Frieder et al. | |
| 3,849,953 | A | 11/1974 | Cohen | |
| 4,062,081 | A | 12/1977 | Ramer | |
| 4,223,506 | A | 9/1980 | Blair et al. | |
| 4,413,369 | A | 11/1983 | Terrien et al. | |
| 4,779,298 | A * | 10/1988 | Nichols et al. | 14/69.5 |

(Continued)

FOREIGN PATENT DOCUMENTS

GB 2337506 A * 11/1999

*Primary Examiner*—Raymond W Addie
(74) *Attorney, Agent, or Firm*—Dunlap Codding, P.C.

(57) ABSTRACT

A tactical footbridge comprises two or more bridge segments and one or more pivotal connection assemblies. The one or more pivotal connection assemblies engage two of the at two or more bridge segments. Each pivotal connection assembly comprises a first member, a second member, a first axial connector, and a second axial connector. The first member engages a first of the two bridge segments. The first member has a pivot hole and a bridge hole. The second member engages a second of the two bridge segments. The second member also has a pivot hole and a bridge hole. The first axial connector selectively extends through the pivot holes of the first and second members to pivotally connect the two bridge segments such that the connected bridge segments selectively pivot between a collapsed position in which the connected bridge segments are proximal to one another, and a bridge position in which the connected bridge segments are in an expanded angularly-disposed relationship with one another. The second axial connector selectively extends through the bridge holes of the first and second members to substantially secure the connected bridge segments in the bridge position.

19 Claims, 9 Drawing Sheets

U.S. PATENT DOCUMENTS

| | | | | |
|---|---|---|---|---|
| 5,312,148 | A | 5/1994 | Morgan | |
| 5,325,557 | A | 7/1994 | Penuela | |
| 5,423,101 | A | 6/1995 | Diefendahl et al. | |
| 5,526,544 | A | 6/1996 | Wiedeck et al. | |
| 5,791,717 | A | 8/1998 | Reich et al. | |
| 5,933,898 | A * | 8/1999 | Estes et al. | 14/69.5 |
| 6,119,634 | A * | 9/2000 | Myrick | 119/847 |
| 6,430,769 | B1 * | 8/2002 | Allen | 14/69.5 |
| 6,431,815 | B1 * | 8/2002 | Zarzecki et al. | 414/537 |
| 6,526,706 | B1 | 3/2003 | Fowler | |
| 6,536,064 | B1 * | 3/2003 | Swink et al. | 14/69.5 |
| 6,676,358 | B2 * | 1/2004 | Smith | 414/340 |
| 6,715,177 | B1 * | 4/2004 | Lagergren-Julander | 14/69.5 |
| 6,892,409 | B1 | 5/2005 | Kaup et al. | |
| 7,082,637 | B1 * | 8/2006 | Griffin | 14/69.5 |
| 7,258,384 | B2 * | 8/2007 | Drabik et al. | 296/61 |
| 2004/0172775 | A1 * | 9/2004 | Koretsky et al. | 14/69.5 |
| 2006/0117502 | A1 * | 6/2006 | Lensing | 14/69.5 |
| 2008/0184502 | A1 * | 8/2008 | Roberts | 14/71.1 |

* cited by examiner

LIGHTWEIGHT MODULAR FOOTBRIDGE AND LADDER

CROSS-REFERENCE TO RELATED APPLICATIONS

The present application claims benefit to U.S. Provisional Patent Application No. 60/920,436, filed Mar. 28, 2007, the content of which is hereby expressly incorporated by reference herein in its entirety.

STATEMENT REGARDING FEDERALLY-FUNDED RESEARCH

Not applicable.

NAMES OF THE PARTIES TO A JOINT RESEARCH AGREEMENT

Not applicable.

DETAILED DESCRIPTION OF EXEMPLARY EMBODIMENTS

The present invention generally relates to means for crossing and/or overcoming obstacles such as waterways, ditches, canals, and walls. More specifically, but not by way of limitation, the present invention relates to a lightweight, modular footbridge that may also function as a ladder for climbing.

Numerous situations arise in which it is desirable to have an effective means for permitting individuals to traverse waterways such as streams, drainage channels, and the like. Similarly, numerous situations arise in which it is desirable to have an effective means for permitting individuals to ascend a wall or other elevated obstacle, such as to enter a second or third-story window of a building. Such needs arise in combat and urban-warfare situations where soldiers are often limited in the amount of equipment they can carry. Similar needs also arise in the case of emergency responders such as firemen, police, SWAT teams, and the like which are required to respond quickly to an emergency with only limited amounts of portable equipment. The inherent unpredictability of these situations further requires that such a means for overcoming obstacles be easily adaptable to various obstacles and also easily portable and deployable.

To this end, the present invention is directed to a modular footbridge that may be disassembled and/or collapsed for easy portability, and may be quickly and easily reassembled in a variety of configurations for adaptability and deployability for traversing a variety of obstacles such as streams and ditches. The modular footbridge of the present invention may further be utilized as a ladder for overcoming elevated obstacles such as walls and the like. In this way, the modular footbridge preferably has at least two configurations: a bridge configuration and a ladder configuration. In order to ensure its portability, the modular footbridge is preferably constructed of a durable and relatively lightweight material such as aluminum. In other embodiments, the footbridge may be constructed of any suitable polymer, composite, fiberglass, titanium, alloy, carbon fiber (including carbon nanotube materials), any other suitably durable material, or any combinations thereof. Portability may be of less importance in certain embodiments which may effectively utilize heavier materials such as steel and the like.

Figure 1:
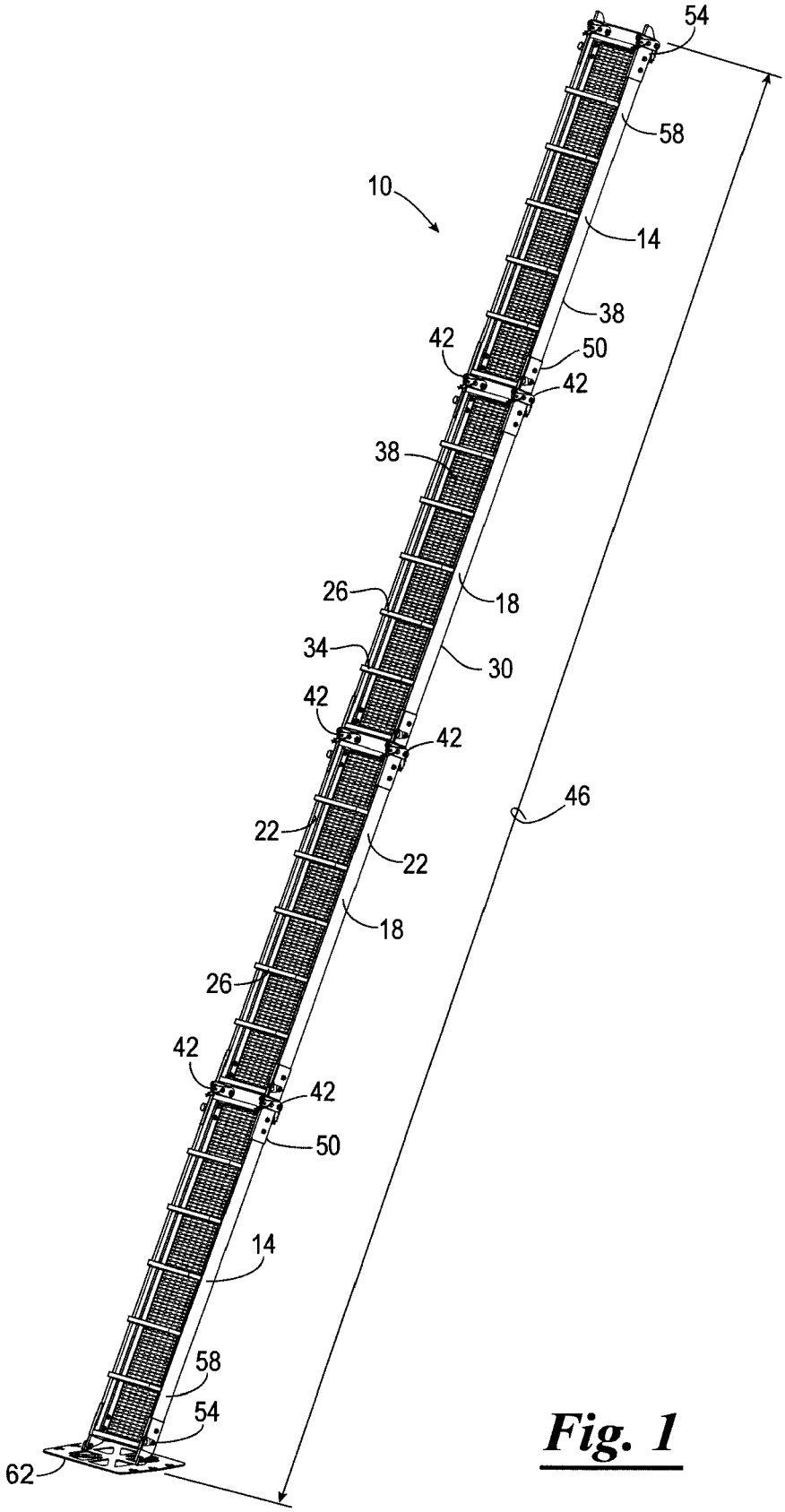
FIG. 1 is a perspective view of one embodiment of a modular footbridge constructed in accordance with the present invention, shown in a ladder configuration.

Referring now to the drawings, and in particular FIG. 1, shown therein is a perspective view of one preferred embodiment of the modular footbridge 10 constructed in accordance with the present invention and shown in a ladder configuration. The footbridge 10 is also preferably adapted to be selectively deployed in a footbridge configuration, as shown in FIGS. 6 and 7, and described in more detail below. The footbridge 10 preferably comprises two end segments 14 and two medial segments 18. Other embodiments of the footbridge 10 may comprise any number of medial segments 18 and up to two end segments 14. For example, to traverse a short wall, a footbridge 10 may be assembled with two end segments 14 and no medial segments 18. Each segment 14 or 18 preferably has a ladder-like construction comprising a pair of longitudinal members 22 and a plurality of lateral members 26 extending between the longitudinal members 22. In other embodiments, the segments 14 or 18 may comprise only one longitudinal member 22 with lateral members 26 extending from one or both sides of the longitudinal member 22. Similarly, the segments 14 or 18 may comprise more than two longitudinal members 22 with lateral members 26 extending therebetween or therefrom. Each segment 14 or 18 preferably further includes an upper side 30 and a lower side 34, which may also be referred to as the footbridge side 30 and ladder side 34.

The footbridge side 30 is provided with a walking surface 38 that generally faces up when the footbridge 10 is in use in its bridge configuration. The walking surface 38 is preferably constructed from expanded metal, that has been cut and/or stretched to provide a number of substantially-equivalent protrusions so as to make a non-slip surface. In other embodiments, the walking surface 38 may be constructed with a rigid or flexible solid sheet of material, a plurality of slats or wires, or any combination of materials and structures which provide a surface or equivalent that is capable of supporting an individual or small vehicle while traversing the footbridge 10 in its bridge configuration. For example, the walking surface 38 may be constructed or formed from strap, fabric, netting, or the like which may be fastened and/or stretched to or about a portion of the footbridge 10. In other embodiments of the present invention, the footbridge 10 may comprise any combination of end segments 14 and medial segments 18 that permit the footbridge 10 to function as a bridge, a ladder, a scaffold, or any other secondary purposes to which the invention lends itself.

Each of the segments 14 or 18 preferably attaches to, connects to, or otherwise engages the immediately-adjacent segment 14 or 18 via a pair of connection assemblies 42. It should be understood that embodiments comprising less or more longitudinal members 22 will likely utilize a correspondingly smaller or greater number of connection assemblies 42. Each longitudinal member 22 of a segment 14 or 18 will preferably be attached to the corresponding longitudinal member 22 of the adjacent segment 14 or 18 via a single connection assembly 42. For example, adjacent segments having only a single longitudinal member 22 will preferably attach to one another via only a single connection assembly 42. In addition to connecting adjacent segments 14 or 18, the connection assemblies 42 are preferably used to adjust the configuration of the footbridge 10. The footbridge 10 in FIG. 1 is depicted in the ladder configuration. That is, all segments 14 or 18 are arranged in a substantially co-planar manner such that the length 46 of the footbridge 10 is maximized for the given number of segments 14 or 18.

The end segments 14 preferably have a connection assembly 42 attached to a medial end 50 and a terminal connector 54 attached to a distal end 58. The terminal connector 54 shown is merely exemplary and other embodiments of the terminal connector 54 may be constructed with any suitable shape or connection means for attaching objects or devices to the end of the footbridge 10. For example, the terminal connector 54 may be adapted to bolt directly to a vehicle (not shown) or to fit over a standard ball hitch, such as on a vehicle. In the embodiment shown, the footbridge 10 is provided with a base plate 62 that pivotally attaches to the distal end 58 via the terminal connector 54.

Figure 2:
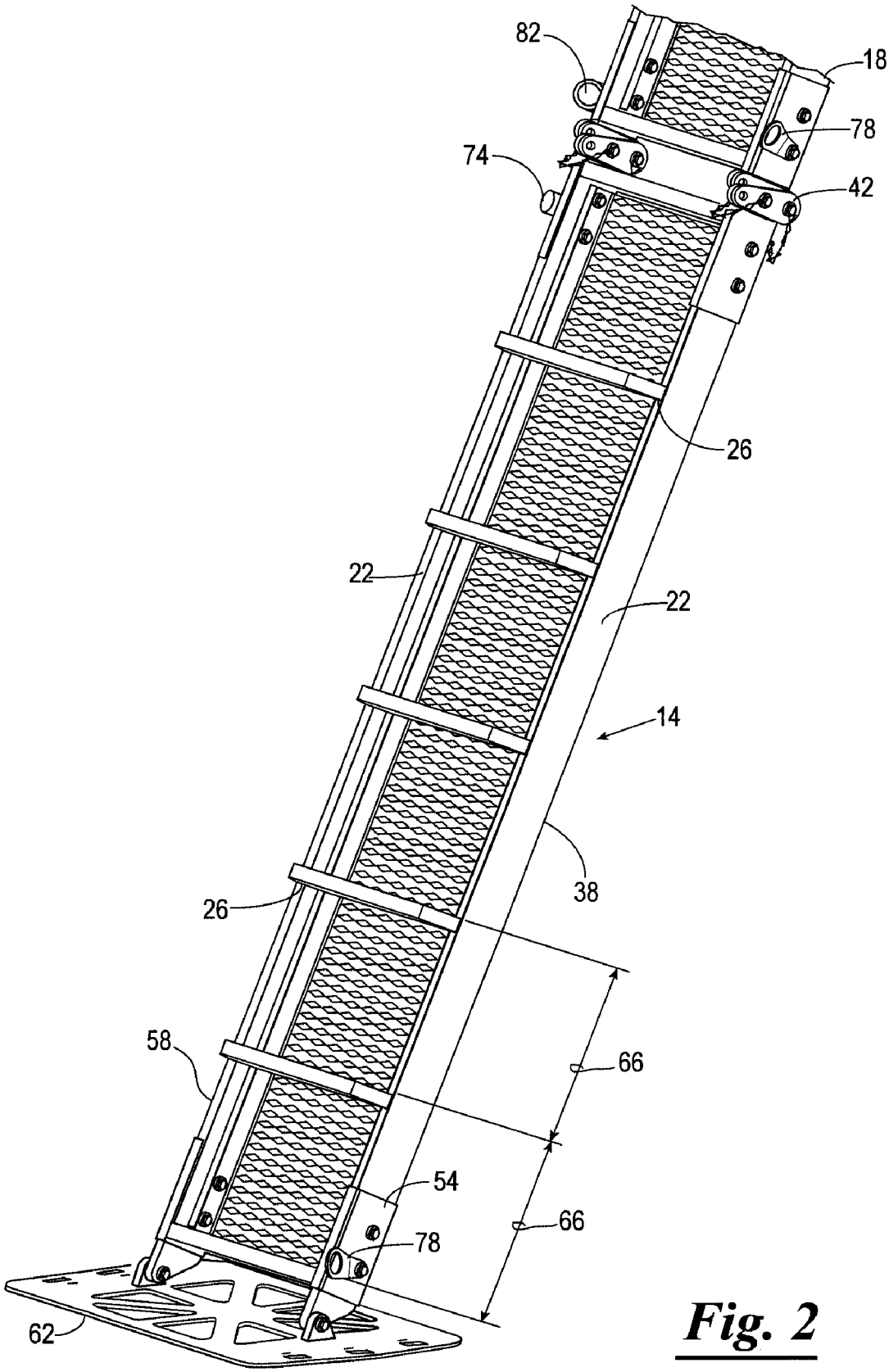
FIG. 2 is a perspective view of a base segment of the footbridge of FIG. 1.
Figure 3:
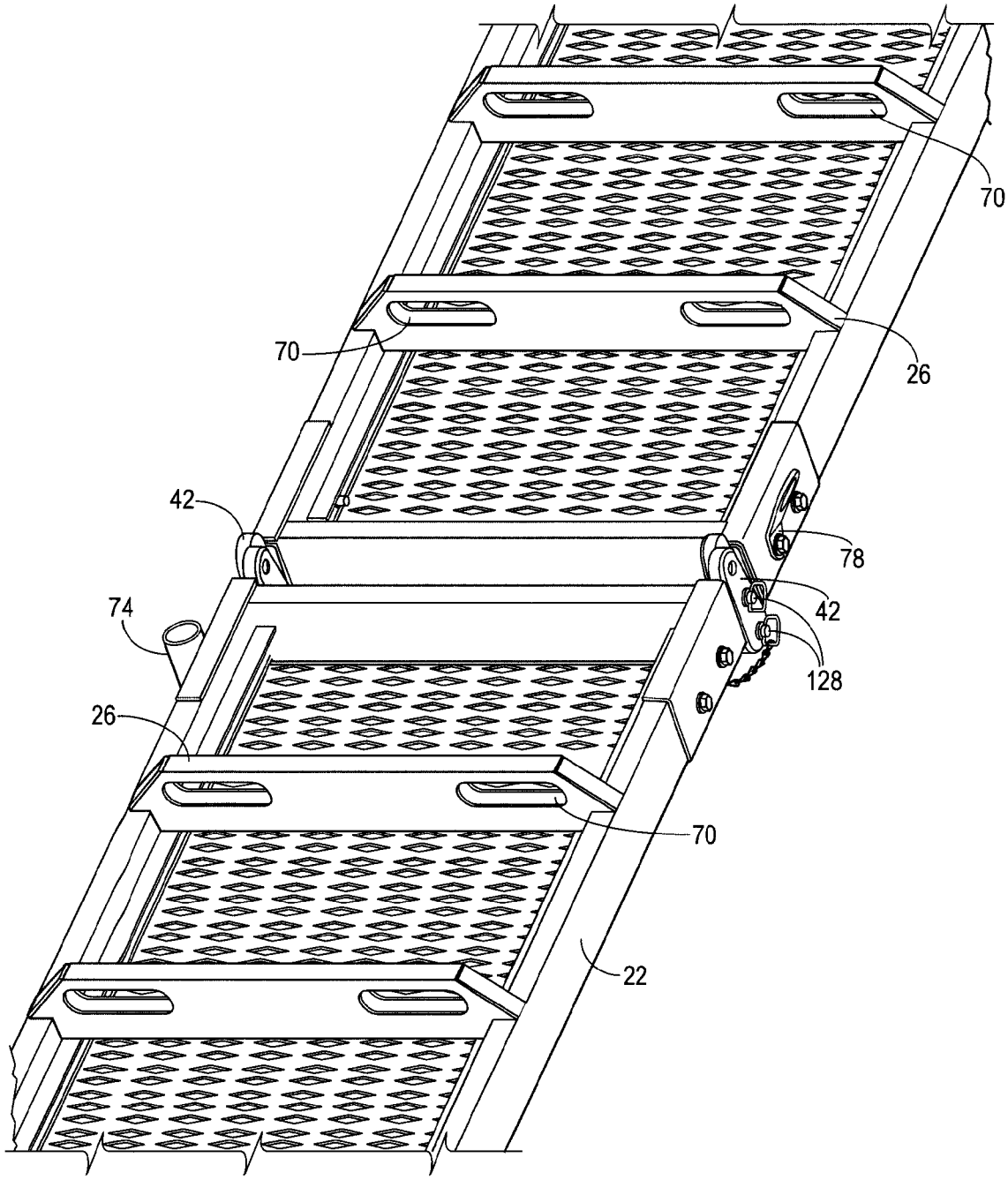
FIG. 3 is an enlarged perspective view of segments of the footbridge of FIG. 1.

Referring now to FIGS. 2 and 3, enlarged perspective views of an end segment 14 and of the lateral supports 26 are depicted. The lateral supports 26 extend between the longitudinal supports 22. The lateral supports 26 preferably provide or function as "steps" or "rungs" to permit an individual to climb the footbridge 10 when in a ladder configuration. To this end, the lateral supports 26 are incrementally spaced at preferably equal distances 66. The distance 66 can be any suitable length that permits an individual to climb effectively and adequately supports the longitudinal supports 22 and the walking surface 38. For example, the distance 66 may be 8", 12", or 18". In other embodiments, the distance 66 may vary between lateral supports 26. As best shown in the exemplary embodiment of FIG. 3, the lateral supports 26 are preferably deeper than the longitudinal supports 22 so as to provide a larger area for climbing when the footbridge 10 is in a ladder configuration. The lateral supports 26 also preferably include openings 70 (FIG. 3) sized to permit a human hand to grasp the lateral support 26 so as to facilitate climbing the footbridge 10 in its ladder configuration or carrying the footbridge 10. In other embodiments, the lateral supports may be constructed so as to be flush with the longitudinal supports 22, for example, to reduce the weight of the footbridge 10. Similarly, the openings 70 may be modified or omitted entirely in other embodiments, as desired for various applications. For example, a lip (not shown) could be provided on one or more lateral supports 26 or one or more longitudinal supports 22 to facilitate grasping a segment 14 or 18.

In the preferred embodiment, the connection assemblies 42 are provided with one handrail attachment member 74 and a pair of anchor members 78. The terminal connector 54 is also preferably provided with at least one anchor member 78. Alternatively, or in addition, anchor members 74 may be provided nearly anywhere on the footbridge that may be advantageous for specific applications. The handrail attachment member 74 provides a connection point for selective attachment of a handrail support, which will be described in more detail below. The anchor members 78 provide connection points for numerous possible purposes, for example: anchoring the footbridge 10 to a building in a ladder configuration, anchoring the footbridge 10 to a vehicle for transport, or anchoring a safety line to the footbridge 10. The anchor members 78 preferably have a hole 82 formed therethrough such that a rope or clip can be fastened to the anchor member 78. In the preferred embodiment, the anchor members 78 are fastened to the footbridge 10 with one or more bolts or rivets to facilitate easily assembly and replacement. The anchor members 78 may also be attached to the footbridge 10 with any other suitable fastening means such as welds, screws, adhesives, clips, or the like. In addition, the footbridge 10 may be provided with additional clips or mounts (not shown) as desired to mount or attach equipment, supplies, accessories, or the like. For example, the footbridge 10 may be provided with clips or mounts for affixing light sources for night crossings and the like.

Figure 4:
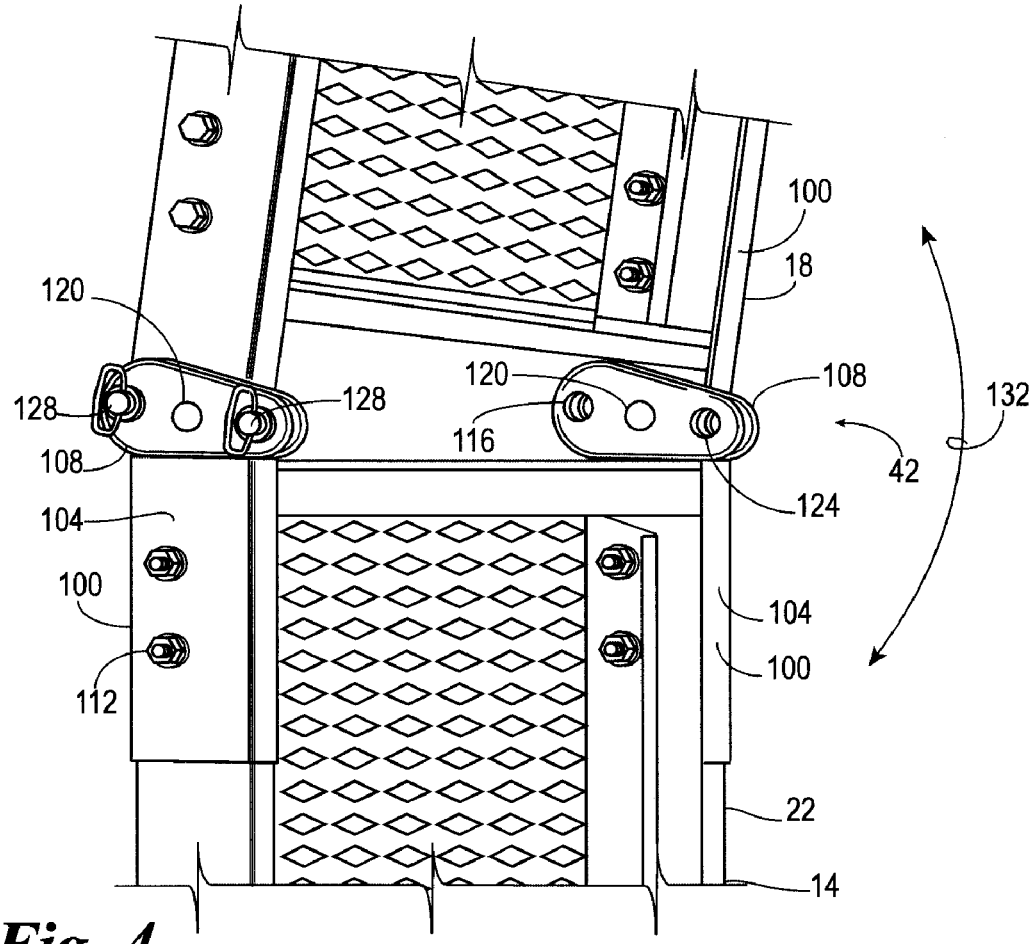
FIG. 4 is a perspective view of one embodiment of a connection assembly for joining segments to form a modular footbridge or ladder and for adjusting the configuration thereof.
Figure 8A:
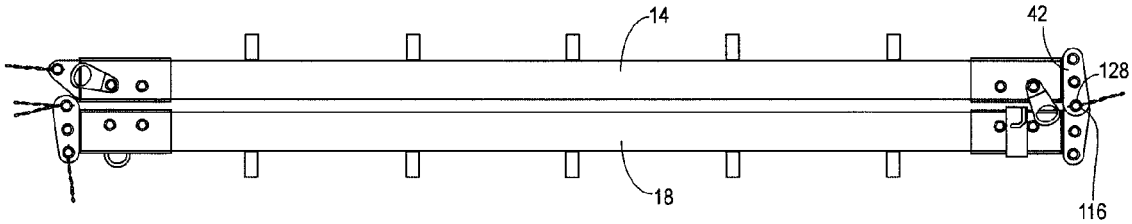
FIG. 8A is a side elevational view of the modular footbridge of FIG. 1 in a collapsed configuration for storage and transportation.
Figure 8B:
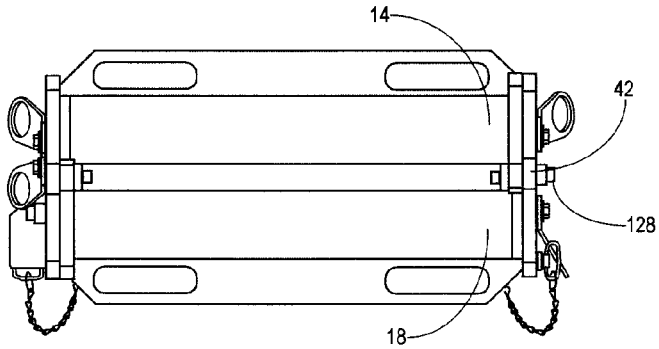
FIG. 8B is an end elevational view of the modular footbridge of FIG. 1 in a collapsed configuration.

Referring now to FIG. 4, one preferred embodiment of the connection assembly 42 is depicted in greater detail. Each connection assembly 42 comprises a pair of connection members 100, each engaging a corresponding longitudinal support 22 of an adjacent segment 14 or 18. Each connection member 100 preferably includes an attachment portion 104 and an adjustment portion 108. The attachment portion 104 is shown attached to the corresponding longitudinal support 22 with a pair of standard bolts 112. Such attachment methods are well known in the art and the bolts 112 may be replaced with any suitable attachment means, including but not limited to: welds, adhesives, screws, interlocking or engaging grooves or protrusions, magnets, tabs, snaps, or the like, or any combination thereof. In the preferred embodiment, the adjustment portion 108 comprises a pivot hole 116, a ladder configuration hole 120, and a bridge configuration hole 124. As shown, the pivot hole 116 is preferably offset from the axis of the longitudinal member 22 such that connected segments 14 or 18 may be pivoted about the axis of the pivot hole 116 in such a way to as be proximal to one another, as shown in FIGS. 8A and 8B and described in more detail below.

As shown, when the footbridge 10 is in either of the ladder and bridge configurations, the adjustment portions 108 are preferably secured relative to one another via two axial connectors 128 such as, for example, pins 128: one pin 128 extending through the pivot hole 116 and one pin 128 extending through one of the configuration holes 120 or 124. As shown in FIG. 3, when one pin 128 is inserted through the pivot hole 120 and one pin is inserted through the ladder hole 120, the adjacent segments 14 or 18 are substantially aligned. As shown in FIG. 4, when one pin 128 is inserted through the pivot hole 120 and one pin 128 is inserted through the bridge hole 124, the adjacent segments 14 or 18 are in a bridge position in which the segments are still expanded relative to one another, but are disposed at an angle 132 relative to one another. The angle 132 in the bridge position is preferably between about 90 degrees and about 175 degrees, and in some embodiments, the connection assembly 42 may be adapted such that the angle 132 is adjustable. When in the bridge position, the angle 132 is always less than 170 degrees, and more preferably less than 170 degrees such that the adjacent segments 14 or 18 are angularly disposed relative to one another and are not substantially aligned or coplanar, as they are in the ladder configuration. In this bridge position, the segments 14 or 18 in held in this expanded angularly-disposed relationship with one another in which the segments 14 or 18 are not coplanar, but are still expanded relative to one another.

In other embodiments, the connection assembly 42 may be constructed without the ladder hole 120, such that connection assembly 42 has only a pivot hole 116 and a bridge hole 124. In such embodiments, the angle between the segments 14 or 18 when in the bridge position may be 180 degrees such that the segments 14 or 18 are substantially coplanar and aligned. In such embodiments, there would only be two positions or configurations when segments 14 or 18 are connected by a connection assembly 42: a collapsed position and a bridge position. However, when the bridge position results in the segments 14 or 18 being substantially coplanar or aligned, the bridge position may be suitable for use a ladder as well.

Figure 4A:
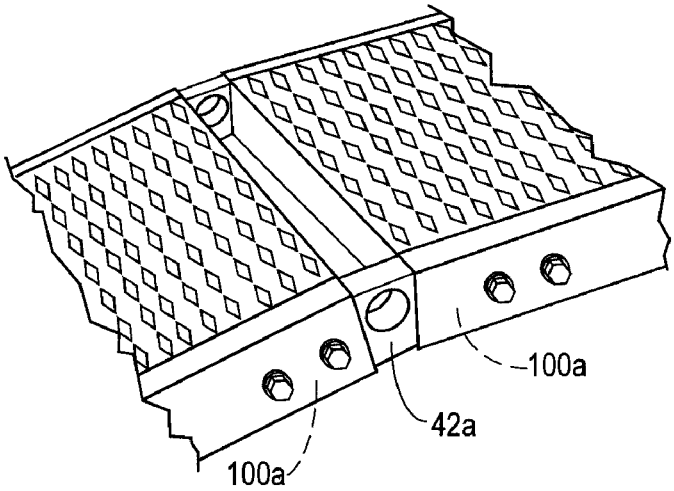
FIG. 4A is a perspective view of another embodiment of a connection assembly constructed in accordance with the present invention.

Referring now to FIG. 4A, another embodiment of a connection assembly 42*a* constructed in accordance with the present invention is shown. The connection assembly 42*a* is a single-piece member having attachment portions 100 adapted to be inserted into the corresponding longitudinal supports 22 of the adjacent segments 14 or 18. As with the connection assembly 42 above, the connection assembly 42*a* may be constructed in an aligned ladder configuration, an angled footbridge configuration, or any other configuration which may enable practical implementation of the present invention.

Figure 5:
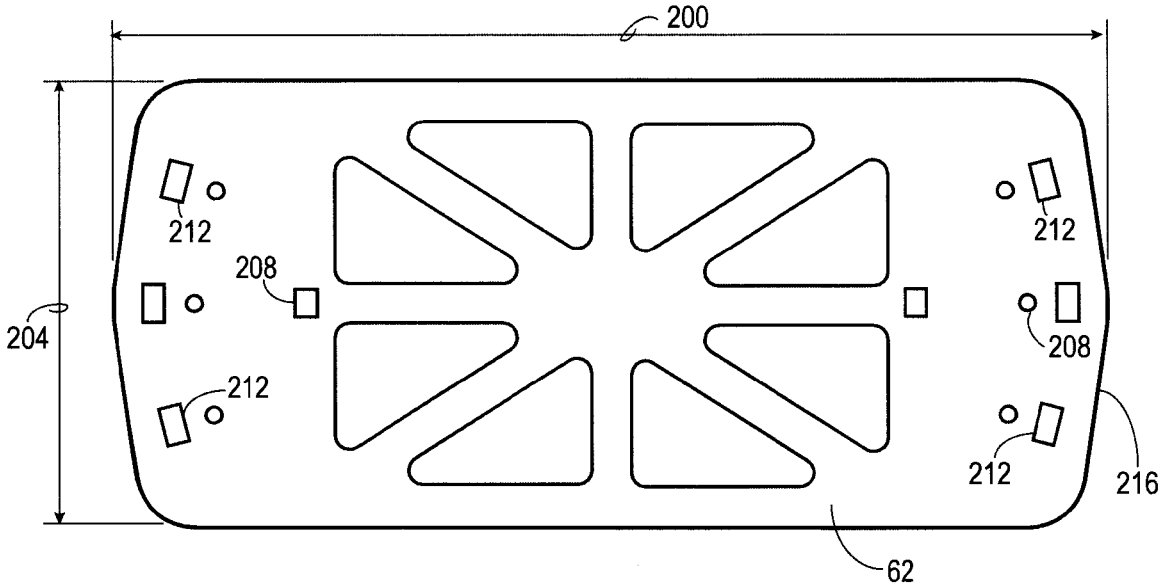
FIG. 5 is a top plan view of one embodiment of a base plate for use with the modular footbridge of FIG. 1.

Referring now to FIG. 5, a top plan view of one embodiment of a base plate 62 is shown. The base plate 62 is preferably provided with a generally-rectangular shape having a width 200 and a length 204. In the preferred embodiment, the base plate 62 is provided with a pair of footbridge connectors 208 corresponding to the terminal connectors 54 of the end segments 14 (FIG. 2). The footbridge connectors 208 preferably protrude upwards from the base plate 62 to provide a pivoted connection to permit the base plate 62 to be easily adjusted to adapt, for example, to uneven terrain. Additionally, the base plate 62 is preferably provided with a plurality of holes 212 near the peripheral edge 216. The holes 212 provide a means for stabilizing the base plate 62, such as by staking it into the ground, bolting it to the bed of a truck, or by any other suitable methods. The base plate 62 may also be constructed in any other shape that provides a suitable base for the footbridge 10 in either of a ladder configuration or a footbridge configuration. In other embodiments, the base plate 62 may also be omitted entirely.

Figure 6A:
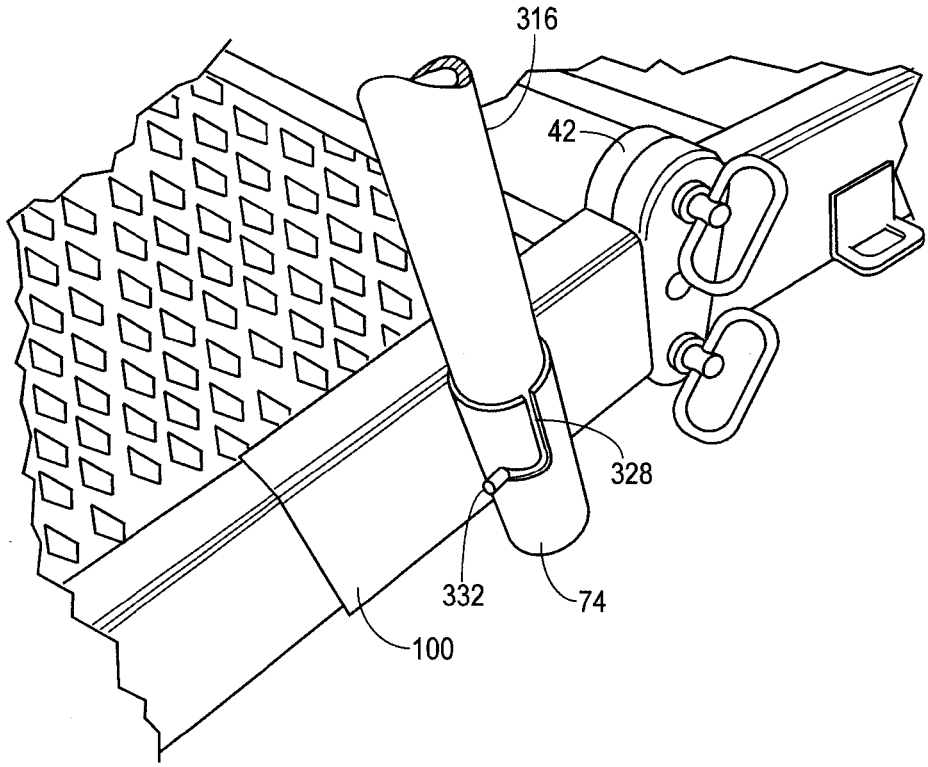
FIG. 6A is a perspective view of a handrail connector assembly with a handrail support inserted therein.
Figure 6:
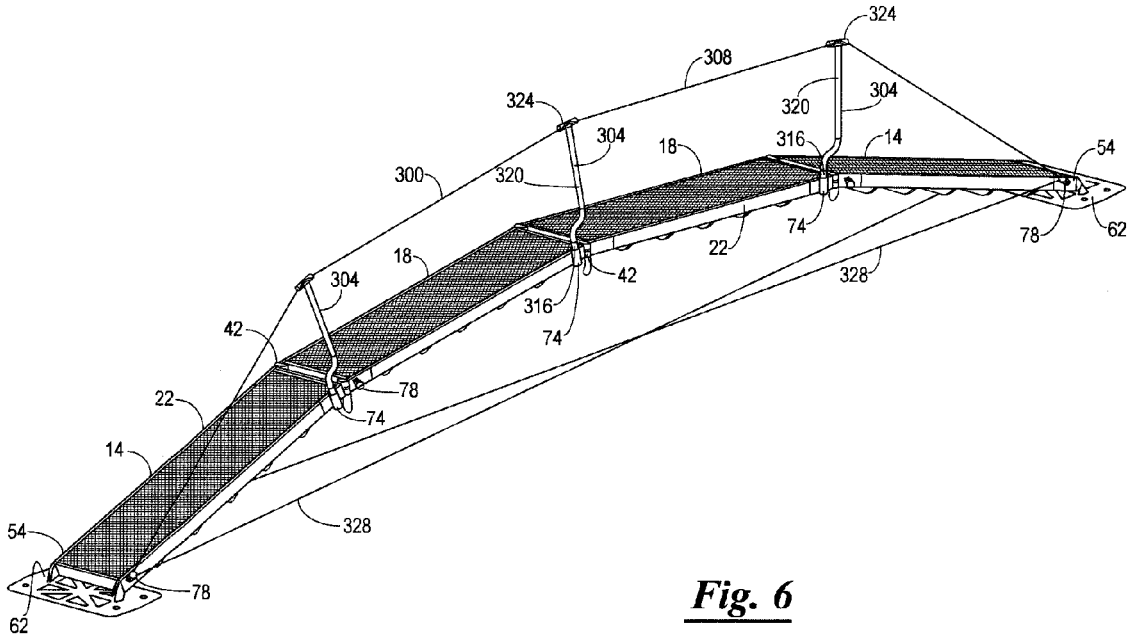
FIG. 6 is a perspective view of the modular footbridge of FIG. 1, shown in a footbridge configuration.
Figure 7:
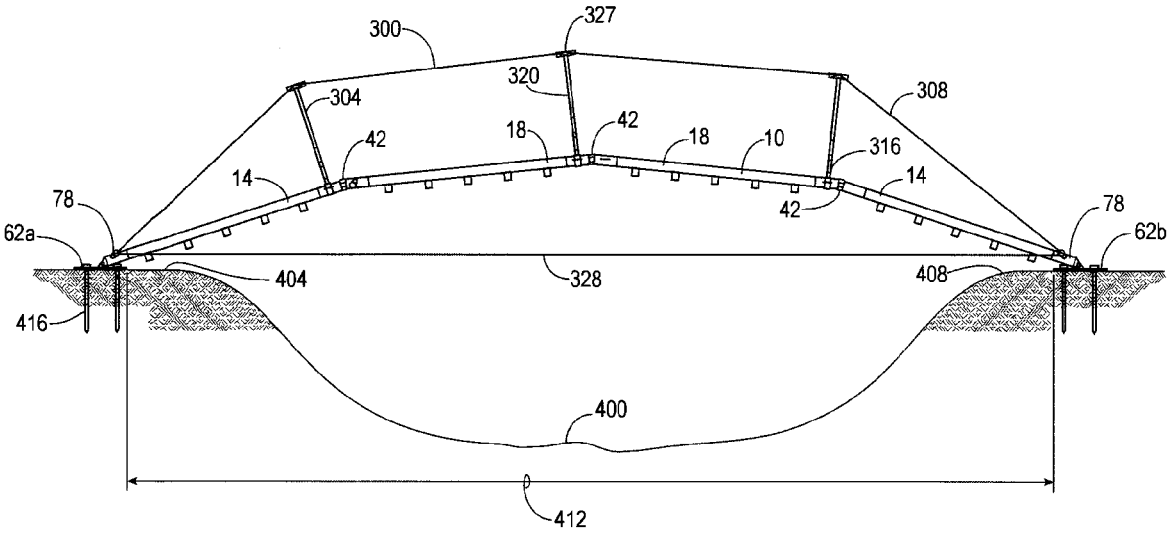
FIG. 7 is a side elevational view of the modular footbridge of FIG. 6.

Referring now to FIGS. 6 and 6A, a perspective view of the footbridge 10 is shown in a footbridge configuration, as well as an enlarged view of a handrail attachment member 74. When deployed in the footbridge configuration, the footbridge 10 preferably includes a handrail 300. The handrail 300 generally comprises a plurality of handrail supports 304 and a handrail cord 308. The handrail supports 304 are connected to the footbridge 10 at the handrail attachment members 74. Each handrail support 304 preferably includes a base portion 316, an extension portion 320, and a guide portion 324. The handrail cord 308 may be constructed of any suitably durable cord, such as a cable, rope, wire, chain, or the like.

The base portion 316 preferably inserts into the handrail attachment member 74. As best shown in FIG. 6A, the handrail connection member 74 includes a retention slot 328. In the preferred embodiment, the base portion 316 of the handrail support 304 is provided with a corresponding retention pin 332. In this way, assembly is accomplished by inserting the base portion 316 into the handrail attachment member 74 with the retention pin 332 aligned with the retention slot 328. As the base portion 316 is inserted, the handrail support 304 is rotated to seat the retention pin 332 and thereby substantially secure the handrail support 304 in the handrail attachment member 74. The extension portion 320 extends from the base portion 316 to the guide portion 324 to elevate the handrail to a functional height. The guide portion 324 is a preferably hollow member through which the handrail cord 308 is threaded to create the functional handrail 300 as shown. In other embodiments, the guide portion 324 may be provided with a slot through which the handrail cord 308 may be passed without having to thread it through the guide member 324.

To assemble handrail 300, the handrail supports 304 are connected to the footbridge 10, as described above, and the handrail cord 308 is sequentially threaded through each of the guide portions 324. Each end of the handrail cord 308 is then fastened to a corresponding anchor member 78 at each end of the footbridge 10. The handrail cord 308 is preferably tensioned prior to or concurrently with being fastened to the anchor members 78 such that a downward force is provided to the handrail supports 304 and the handrail 300 will be stable enough to provide support to individuals crossing the footbridge 10.

When the preferred embodiment of the footbridge 10 is deployed in a footbridge configuration, it can be provided with one or more stiffener straps 328. Two stiffener straps 328 are shown by way of example. The stiffener straps 328 are preferably selectively connected to the anchor points 78 at either end of the footbridge 10, via a connection means such as snap-rings, carabiners, snap hooks, or the like. In other embodiments, the stiffener straps 328 may be tied to the anchor points 78 by hand as necessary. The stiffener straps 328 preferably extend from one end of the footbridge 10 to the next, preferably at an angle or across the width of the bridge 10 as well as the length. For example, a first stiffener strap would extend from the right side of the first end to the left side of the second end of the footbridge 10, and a second stiffener strap 328 would extend from the left side of the first end to the right side of the second end of the footbridge 10. In this way, the straps provide tension between the two ends of the footbridge 10, as well as provide resistance to torsional loads that may be created by uneven terrain or uneven load distribution upon the footbridge 10. The stiffener straps 328 may be constructed of any suitably-durable cord-like material, for example chain, strap, rope, cable, wire, or the like. In other embodiments, the stiffener straps 328 may extend from a segment 14 or 18 to the next sequential segment 14 or 18; from an end segment 14 to a medial segment 18; or in any other suitable configuration.

In some embodiments, it is desirable to construct the connection assemblies 42 such that the connection assemblies alone are not sufficiently strong to alone support the footbridge 10 or a weight on the footbridge 10 when in the bridge configuration or position. For example, this may be desirable to reduce the weight of the footbridge 10. However, in such embodiments, the stiffener straps 328 preferably cooperate with the connection assemblies 42 and the segments 14 or 18 to provide sufficient strength to support both the footbridge 10 and a suitable weight or working load on the footbridge 10 to enable it to function in the bridge configuration or position.

Referring now to FIG. 7, a side elevational view of the footbridge 10 deployed across an obstacle is shown. The footbridge is shown deployed across a channel 400 having a first side 404, a second side 408, and a width 412. As shown, the width 412 of the channel 400 is nearly as large as the span of the footbridge 10. It will be appreciated by those skilled in the art that the footbridge 10 having four segments 14 or 18 as shown will be sufficient to cross a channel narrower than width 412. However, the footbridge 10 may also be modified by adding additional medial segments 18 so as to increase the span of the footbridge 10. It will also be appreciated by those skilled in the art that adding additional segments may decrease the load capacity of the footbridge 10. Additionally, for channels 400 narrower than width 412, it may be desirable to assemble the footbridge 10 with only one medial segment 18 or with no medial segments 18, as needed.

As shown, when deployed in the footbridge configuration, the footbridge 10 preferably has a base plate 62 attached to each end segment 14 so as to stabilize both ends of the footbridge 10. The base plates 62 can be positioned and staked to the ground with one or more stakes 416 to provide additional stability to the footbridge 10. In one preferred method of deployment, the footbridge 10 is assembled on a first side 404 of the channel 400. A first base plate 62*a* is then staked to the ground with one or more stakes 416, and the footbridge is pivoted, relative to the staked base plate 62*a*, into position across the channel 400. An individual may then cross the footbridge 10 and stake the second base plate 62*b* with one or more stakes 416 to secure the footbridge 10 in position for additional individuals to cross the channel 400. Once all individuals have crossed the channel 400, the stakes 416 can be removed to free the first base plate 62*a* and the footbridge 10 can be pivoted, relative to the second base plate 62*b*, across to the second side 408 of the channel 400. The stakes 416 can then be removed to free the second base plate 62*b* and the footbridge 10 disassembled or collapsed to be transported with the individuals or stored for a later return.

Referring now to FIGS. 8A and 8B, one half of the footbridge 10 of FIG. 1 is shown in a collapsed position for transport or storage. As shown, the connection assembly 42 is designed such that a pin 128 can be left in the pivot hole 116 such that adjacent segments 14 or 18 may be folded flat against one another to facilitate transport or storage of the footbridge 10. In the collapsed position, two segments 14 or 18 preferably remain connected by the connection assembly 42, and more particularly by the axial connector 128 extending through the pivot hole 116 (FIG. 4), but are pivoted relative to one another such that the segments 14 or 18 are proximal to one another, and more preferably such that the segments 14 or 18 are substantially parallel to one another.

Figure 9:
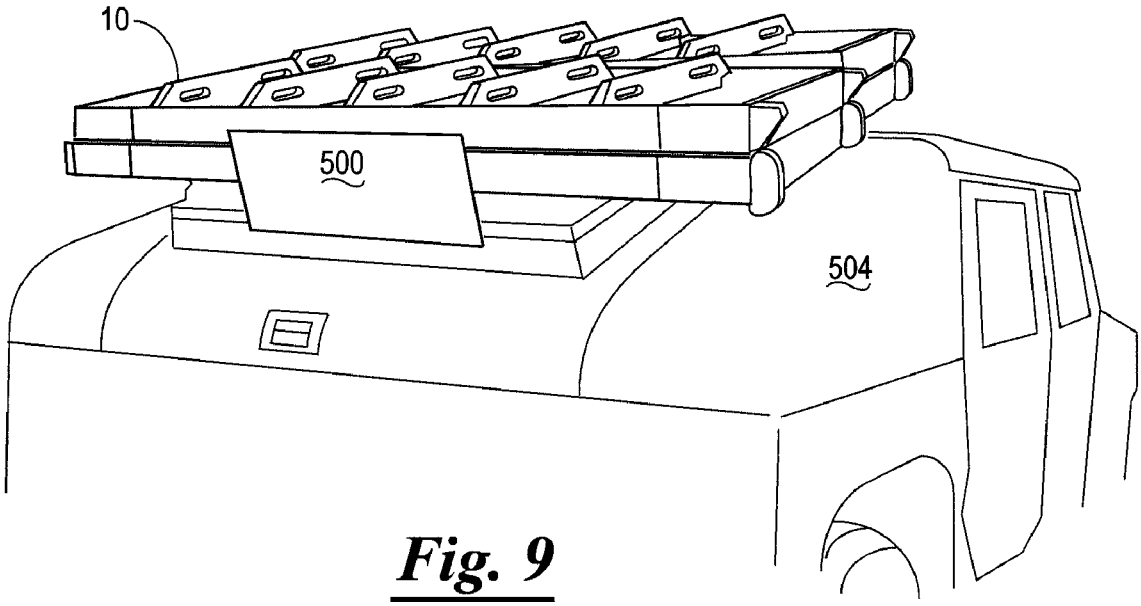
FIG. 9 is a perspective view of a modular ladder and footbridge, in a collapsed configuration, positioned on a roof rack of a vehicle for transport.

Referring now to FIG. 9, shown therein is the footbridge 10, in the collapsed configuration of FIGS. 8A and 8B, positioned on the roof rack 500 of a vehicle 504. As shown, the modular design of the preferred embodiment of the footbridge 10 is well-suited for easy storage and transportation. The roof rack 500 is exemplary and is not the only roof rack 500 that will conveniently carry the footbridge 10 in its collapsed configuration. For example, U.S. patent application Ser. Nos. 11/010,457, filed Dec. 13, 2005, and 11/511,161, filed Aug. 28, 2006; the entire content of both patent applications is hereby incorporated by reference disclose other exemplary roof racks 500 capable of carrying the footbridge 10. With some embodiments of the footbridge 10, it will be desirable to distribute the footbridge 10 with a roof rack 500 that is well-suited to its transportation. Some such roof racks 500 may even be specially-modified to carry a specific embodiment of a footbridge 10. In other embodiments, a roof rack 500 may not be necessary to transport the footbridge. For example, the footbridge 10 could be placed in the bed of a truck or the like. Similarly, the vehicle 504 is shown as a Humvee, but numerous other vehicles can be used to transport the footbridge 10.

Changes may be made in the construction and the operation of the various components, elements and assemblies described herein or in the steps or the sequence of steps of the methods described herein without departing from the spirit and scope of the invention.

What is claimed is:

1. A tactical footbridge that can also function as a ladder, the footbridge comprising:

two or more bridge segments; and one or more pivotal connection assemblies engaging two of the two or more bridge segments, each pivotal connection assembly comprising:

a first member engaging a first of the two bridge segments, the first member having a pivot hole, a ladder hole and a bridge hole; and a second member engaging a second of the two bridge segments, the second member having a pivot hole, a ladder hole and a bridge hole;

a first axial connector selectively extending through the pivot holes of the first and second members to pivotally connect the two bridge segments such that the connected bridge segments selectively pivot between a collapsed position in which the connected bridge segments are proximal to one another, and selectively either (1) a ladder position in which the connected bridge segments are in an expanded, substantially aligned relationship with one another, or (2) a bridge position in which the connected bridge segments are in an expanded angularly-disposed relationship with one another, the connected bridge segments forming an angle between about 90 degrees and about 175 degrees; and a second axial connector selectively extending through either (1) the ladder holes of the first and second members to substantially secure the bridge segments in the ladder position, or (2) the bridge holes of the first and second members to substantially secure the connected bridge segments in the bridge position.

2. The tactical footbridge of claim 1, wherein the bridge segments each have an upper side and a lower side and wherein the upper side of each bridge segment further includes a walking surface.

3. The tactical footbridge of claim 1, wherein the bridge segments each have an upper side and a lower side, and wherein the connector assemblies engage the connected bridge segments such that the pivot holes of the first and second members are proximal to the upper side of the bridge segments and the bridge holes of the first and second members are proximal to the lower side of the bridge segments.

4. The tactical footbridge of claim 1, further comprising:

one or more stiffener straps selectively connected to at least two of the two or more bridge segments to at least partially support the footbridge when the bridge segments are substantially secured in the bridge configuration.

5. The tactical footbridge of claim 1, further comprising:

two or more anchor members each engaging one of the bridge segments; and, one or more stiffener straps selectively connected to at least two of the two or more anchor members to at least partially support the footbridge when the bridge segments are substantially secured in the bridge configuration.

6. The tactical footbridge of claim 5, wherein the two or more anchor members comprise four anchor members, the one or more stiffener straps comprise two stiffener straps, and wherein a first of the two stiffener straps is selectively connected to a first and second of the four anchor members and the second of the two stiffener straps is selectively connected to a third and fourth of the four anchor members.

7. The tactical footbridge of claim 6, wherein the two or more bridge segments each have first and second lateral sides, and wherein the anchor members engage the bridge segments and the stiffener straps are selectively connected to the anchor members such that each of the stiffener straps extends between the first and second lateral sides of the bridge segments.

8. The tactical footbridge of claim 1, wherein the two or more bridge segments comprises two end bridge segments and two medial bridge segments disposed between the two end bridge segments, and wherein the one or more pivotal connection assemblies comprises six pivotal connection assemblies.

9. The tactical footbridge of claim 8, further comprising:

two or more anchor members each engaging one of the bridge segments; and, one or more stiffener straps selectively connected to at least two of the two or more anchor members to at least partially support the footbridge when the bridge segments are substantially secured in the bridge configuration.

10. The tactical footbridge of claim 9, wherein the two or more anchor members comprise four anchor members, the one or more stiffener straps comprise two stiffener straps, and wherein a first of the two stiffener straps is selectively connected to a first and second of the four anchor members and the second of the two stiffener straps is selectively connected to a third and fourth of the four anchor members.

11. The tactical footbridge of claim 10, wherein the first and third anchor members engage a first one of the two end bridge segments, and wherein the second and fourth anchor members engage the other of the two end bridge segments.

12. The tactical footbridge of claim 11, wherein the end and medial bridge segments each have first and second lateral sides, and wherein the anchor members engage the end bridge segments and the stiffener straps are selectively connected to the anchor members such that each of the stiffener straps extends between the first and second lateral sides of the end bridge segments.

13. The tactical footbridge of claim 1, wherein the bridge segments each have two or more longitudinal members in spaced-apart relation, and a plurality of horizontal members extending between at least two of the two or more longitudinal members.

14. The tactical footbridge of claim 13, wherein the bridge segments each have an upper side and a lower side and wherein the upper side of each bridge segment further includes a walking surface at least partially supported by one or more of the longitudinal members and the horizontal members.

15. The tactical footbridge of claim 13, further comprising:

one or more stiffener straps selectively connected to at least two of the two or more bridge segments to at least partially support the footbridge when the bridge segments are substantially secured in the bridge configuration.

16. The tactical footbridge of claim 13, further comprising:

two or more anchor members each engaging one of the bridge segments; and, one or more stiffener straps selectively connected to at least two of the two or more anchor members to at least partially support the footbridge when the bridge segments are substantially secured in the bridge configuration.

17. The tactical footbridge of claim 16, wherein the two or more anchor members comprise four anchor members, the one or more stiffener straps comprise two stiffener straps, and wherein a first of the two stiffener straps is selectively connected to a first and second of the four anchor members and the second of the two stiffener straps is selectively connected to a third and fourth of the four anchor members.

18. The tactical footbridge of claim 17, wherein the two or more bridge segments each have first and second lateral sides, and wherein the anchor members engage the bridge segments and the stiffener straps are selectively connected to the anchor members such that each of the stiffener straps extends between the first and second lateral sides of the bridge segments.

19. The tactical footbridge of claim 13, wherein the two or more bridge segments comprises four bridge segments, and wherein the one or more pivotal connection assemblies comprises six pivotal connection assemblies.

* * * * *